US006014770A

United States Patent [19]

Spector

[11] Patent Number: 6,014,770

[45] Date of Patent: Jan. 18, 2000

[54] BOXING TRAINING GLOVES

[76] Inventor: Donald Spector, 380 Mountain Rd., Union City, N.J. 07080

[21] Appl. No.: 09/164,996

[22] Filed: Oct. 1, 1998

[51] Int. Cl.[7] ..... A41D 13/08

[52] U.S. Cl. ..... 2/18; 2/161.1

[58] Field of Search ..... 2/18, 161.1, 16; 446/267; D29/116

[56] References Cited

U.S. PATENT DOCUMENTS

| | | | |
|---|---|---|---|
| 705,915 | 7/1902 | Gamble | 2/18 |
| 1,054,832 | 3/1913 | Dunn | 2/18 |
| 1,106,979 | 8/1914 | Shibe | 2/18 |
| 1,869,216 | 7/1932 | Kennedy | 2/18 |
| 2,056,326 | 10/1936 | Orsini | 2/18 |
| 2,275,206 | 3/1942 | Sutherland | 2/18 |
| 2,416,444 | 2/1947 | Hilton | 2/18 |
| 2,466,793 | 4/1949 | Corbett | 2/18 |
| 4,295,228 | 10/1981 | Dragomir | 2/18 |
| 4,424,595 | 1/1984 | Albert | 2/18 |
| 4,603,439 | 8/1986 | Golomb | 2/18 |
| 5,257,418 | 11/1993 | Jaskiewicz | 2/20 |
| 5,330,249 | 7/1994 | Weber et al. | 297/214 |
| 5,557,803 | 9/1996 | Granich et al. | 2/16 |

*Primary Examiner*—Diana Oleksa
*Assistant Examiner*—Kate Moran
*Attorney, Agent, or Firm*—Michael Ebert

[57] ABSTRACT

A boxing training glove which incorporates characteristics of a heavy bag whereby when a boxer in training wears this glove and punches a hard surface, this acts to build up his muscular strength. The glove is constituted by a heavily-padded leather mitten having an inner liner formed by a plastic film envelope that conforms to the interior of the glove and is filled with a silicone fluid. The viscosity of the confined fluid is such that when the boxer punches the hard surface, the impact force is distributed throughout the liner by the silicone fluid, thereby replicating the effects of a heavy bag and avoiding injury to the hand wearing the glove.

7 Claims, 1 Drawing Sheet

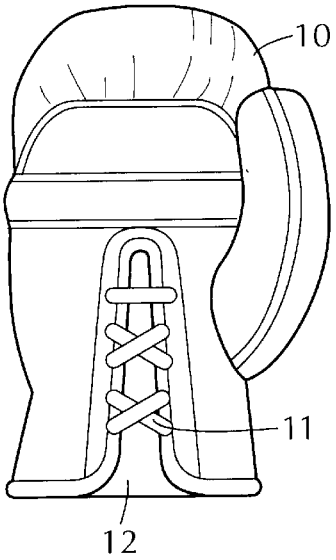
FIG. 1
FIG. 2
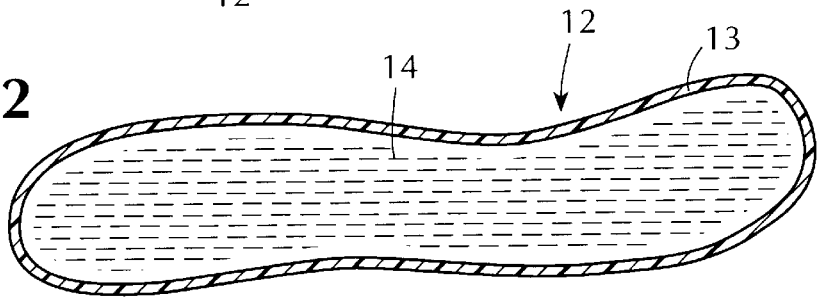
FIG. 3
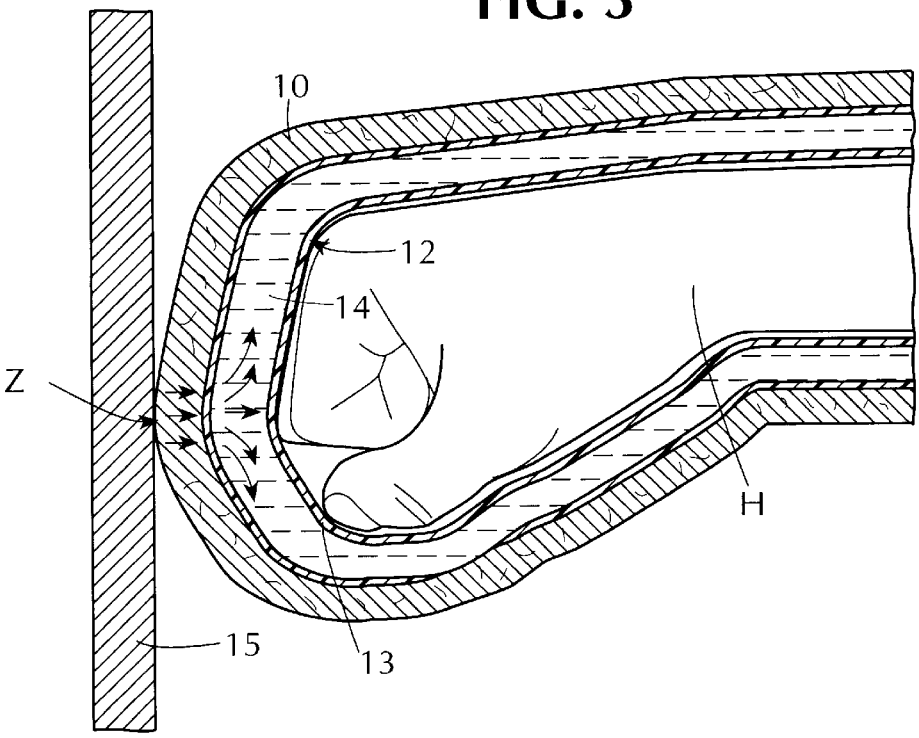

BOXING TRAINING GLOVES

BACKGROUND OF THE INVENTION

1. Field of Invention

This invention relates generally to a training glove for a boxer which dispenses with the need for a heavy bag to build up the muscular strength of a boxer, for the training glove incorporates characteristics of a heavy bag.

2. Status of Prior Art

The sport of boxing in which boxers fight with their fists goes back in history at least as far back as the Olympic games in ancient Greece. In these games the boxers wound heavy straps of leather about their hands and wrists. It was not until the 19th century that boxers began to wear boxing gloves in the form of heavily-padded leather mittens.

Commonly used in the training of boxers is the punching bag. This stuffed or inflated bag which is to be punched for exercise, is usually suspended though in some cases it is supported on a flexible rod. When a punching bag is struck by the glove of a boxer, it swings away from the glove and then swings back. By timing his punches, a skilled boxer can cause the punching bag to oscillate at a rapid rate. But because a punching bag is deflected by a boxer's punch, the impact force of a punch is relatively weak. Hence a boxer who trains with a punching bag does not in doing so build up his muscular strength but only his agility.

It is for this reason that boxers in training, make use of a heavy bag to enhance their muscular strength. A typical heavy bag is suspended from the ceiling and is filled with sand or similar material. When a heavy bag is struck by the glove of a boxer, the impact force is high, for the inertia of the bag resists deflection of the bag in reaction to the punch.

However the force of impact is not confined to the zone of contact between the glove and the heavy bag, for it is distributed and dissipated throughout the bag by the flowable sand therein. It is for the same reason that in jujitsu training, in order to build up muscular strength one punches into a container of rice rather than against a rigid hard surface.

Should a boxer in training strike a hard surface with his boxing glove, the concentrated force of impact could inflict injury to his hand despite the protection afforded by the padded boxing glove.

A heavy bag is standard equipment in gyms for training boxers. But since many boxers also train at home, there are commercially available heavy bags for domestic use. The problem with installing a heavy bag in the home rather than in a gym is that it is difficult to securely anchor the suspension cable of the bag on the ceiling. And the expense of a heavy bag coupled with its space requirements often militate against a home installation.

SUMMARY OF INVENTION

In view of the foregoing, the main object of this invention is to provide a boxing training glove which when used in training exercises acts to build up the muscular strength of the boxer.

More particularly, an object of this invention is to provide a training glove of the above type which incorporates therein characteristics of a heavy bag, thereby dispensing with the need for this bag.

A significant advantage of a boxing training glove in accordance with the invention is that it makes it possible for a boxer to train at home rather than in a gym.

Also an object of the invention is to provide a training glove which combines the structure of a standard padded leather mitten with an inner liner which imparts to the mitten characteristics of a heavy bag.

Briefly stated, these objects are attained by a boxing training glove which incorporates characteristics of a heavy bag whereby when a boxer in training wears this glove and punches a hard surface, this acts to build up his muscular strength. The glove is constituted by a heavily-padded leather mitten having an inner liner formed by a plastic film envelope that conforms to the interior of the glove and is filled with a silicone fluid.

The viscosity of the confined fluid is such that when the boxer punches the hard surface the impact force is distributed throughout the liner by the silicone fluid, thereby replicating the effect of a heavy bag and avoiding injury to the hand wearing the glove.

BRIEF DESCRIPTION OF DRAWING

For a better understanding of the invention as well as other objects and further features thereof, reference is made to the following detailed description to be read in conjunction with the accompanying drawings, wherein:

FIG. 1 shows a standard boxing glove that has been modified to include an inner liner to form a training glove in accordance with the invention;

FIG. 2 is a section taken through the liner;

FIG. 3 schematically illustrates the impact force produced when a training glove in accordance with the invention worn by a boxer punches a hard surface.

DESCRIPTION OF INVENTION

Referring now to FIG. 1 shown therein is a training glove in accordance with the invention to be worn by a boxer who seeks by exercise to strengthen his muscles. The boxer is provided with a pair of these gloves to be worn by both hands.

The training glove shown in FIG. 1 has the same basic structure as a standard boxing glove, it being formed by a heavily-padded leather mitten 10 provided with lacing 11 to tighten the glove on the boxer's hand inserted in the glove. In practice, mitten 10 may be fabricated of synthetic leather or plastic material having leather-like properties.

The interior of glove 10 is lined by a liner 12 that is shaped to conform to the contours of the glove interior. As shown separately in FIG. 2, liner 12 is composed of a sealed envelope 13 formed of synthetic plastic film material that is impermeable to liquids and is shaped to conform to the glove interior. Filling envelope 13 is a silicone liquid 14 or a fluid having similar properties.

Silicone is a generic term for a group of polymeric compounds composed of a repeating silicon-oxygen chain. Silicone fluids, the simplest silicones, are made by hydrolysis of organic silicon dichlorides. Liquid silicones have lower viscosity coefficients than most liquids and are more compressible. They are also chemically inert which is why silicones are used in breast implants as well as in other medical applications.

Liner 12 lining the interior of boxing glove 10 imparts thereto characteristics of a heavy bag which when punched then distributes the impact force away from the zone of contact, thereby avoiding injury to the gloved hand of the boxer.

And because the training glove has characteristics of a heavy bag, one can in training dispense with an actual heavy bag and punch a hard, unyielding surface. This surface could be a door in the training room or a wood-covered wall in therein. The solid surface must be capable of taking a beating from the boxer in training.

The result of punching a hard wall or similar surface is illustrated in FIG. 3 in which it is wall 15 that is repeatedly punched by training glove 10. The zone of contact between wall 15 and glove 10 is represented by letter Z, while the force of impact between the wall and the glove is represented by straight arrows extending from contact zone Z into glove 10 toward liner 12 therein.

Thus when glove 10 strikes wall 15, a shock force is produced at the zone of contact which travels into the glove toward its inner liner.

When the shock force reaches silicone fluid 14 within envelope 13, it is dispersed thereby, as shown by the curved arrows and is distributed away from contact zone Z throughout the silicone fluid. Hence the hand H of the boxer inserted within glove 10 which engages inner liner 12 is not subjected to the concentrated force of impact, but to a force that has been dissipated by the silicone fluid 14 which is distributed about the entire interior of the glove.

It is important that the film envelope which encases the silicone fluid be of high strength so that it is not ruptured by repeated punching actions, however rigorous they may be. For this purpose envelope 13 is preferably formed of a biaxially-oriented plastic film of high strength, such as Mylar (polyester) or polypropylene.

In practice, the inner liner may be permanently joined to the glove, or it may be removable therefrom, in which case the glove without the liner can be used as a conventional boxing glove.

While there has been shown and described a preferred embodiment of a boxing training glove in accordance with the invention, it will be appreciated that many changes and modifications may be made therein without, however, departing from the essential spirit thereof.

I claim:

1. A training glove used in combination with a hard surface and having characteristics of a heavy bag whereby when a boxer wearing the glove on his hand repeatedly punches said hard surface, this action builds up his muscular strength, said glove comprising:

A. a heavily-padded fingerless mitten having a contoured interior; and

B. a liner for the mitten conforming to the interior of the mitten, said liner being composed of a sealed plastic film envelope, and a compressible liquid filling the envelope whereby when the glove punches the hard surface to produce at a zone of contact an impact force which is conveyed to the liner, the liquid therein then acts to disperse this force to prevent injury to the hand of the boxer.

2. A glove as set forth in claim 1, in which the liquid is a silicone fluid.

3. A glove as set forth in claim 1 in which the plastic film of the envelope is bi-axially oriented.

4. A glove as set forth in claim 3 in which the film is formed of polyester.

5. A glove as set forth in claim 1, in which the mitten is formed of leather.

6. A glove as set forth in claim 1, in which the mitten is formed of simulated leather.

7. A glove as set forth in claim 1, in which the mitten is provided with lacing to tighten it on the hand of the boxer.

* * * * *